US005551717A

United States Patent [19]

De Courcey Milne

[11] Patent Number: 5,551,717

[45] Date of Patent: Sep. 3, 1996

[54] SPORTS CONVEYANCE

[76] Inventor: John De Courcey Milne, 6/39 Grosvenoer Street, Balmoral, Queensland, 4171, Australia

[21] Appl. No.: 318,709

[22] PCT Filed: Apr. 8, 1993

[86] PCT No.: PCT/AU93/00161

§ 371 Date: Oct. 11, 1994

§ 102(e) Date: Oct. 11, 1994

[87] PCT Pub. No.: WO93/20911

PCT Pub. Date: Oct. 28, 1993

[30] Foreign Application Priority Data

Apr. 9, 1992 [AU] Australia ..... PL1807
Dec. 18, 1992 [AU] Australia ..... PL6443

[51] Int. Cl.[6] ..... B62M 1/00

[52] U.S. Cl. ..... 280/87.042; 280/87.041; 280/11.27

[58] Field of Search ..... 280/87.041, 87.042, 280/87.043, 11.27, 11.28, 11.115, 7.15, 87.021

[56] References Cited

U.S. PATENT DOCUMENTS

| | | | |
|---|---|---|---|
| 1,070,468 | 8/1913 | Henley | 280/87.041 |
| 1,387,091 | 8/1921 | Woodley et al. | 280/87.041 |
| 3,252,713 | 6/1964 | Heller | 280/87.042 |
| 3,565,454 | 6/1969 | Stevenson | 280/87.042 |
| 4,054,297 | 10/1977 | Solimine | 280/11.28 |
| 4,133,546 | 1/1979 | Rosenblun | 280/87.042 |
| 4,159,121 | 6/1979 | Spitzke | 280/87.042 |
| 4,196,916 | 4/1980 | Schorr | 280/87.042 |
| 4,200,302 | 4/1980 | de Rosnay | 280/87.042 |
| 4,740,000 | 4/1988 | Moessner | 280/87.042 |
| 4,941,670 | 7/1990 | Darr | 280/87.021 |
| 5,330,214 | 7/1994 | Brooks et al. | 280/87.042 |

FOREIGN PATENT DOCUMENTS

| | | | |
|---|---|---|---|
| 1405865 | 6/1988 | U.S.S.R. | 280/87.041 |
| 2225990 | 6/1990 | United Kingdom | 280/87.042 |

*Primary Examiner*—Eric D. Culbreth
*Assistant Examiner*—Min Yu
*Attorney, Agent, or Firm*—Abelman, Frayne & Schwab

[57] ABSTRACT

A sports conveyance is disclosed having a frame mounted on a pair of spaced front wheels and also supported by rear wheel means, the front wheels having interconnecting means whereby they may be turned in unison to either side of the longitudinal center line of the conveyance, a board mounted on the frame to support a rider and adapted to be depressed at a respective side of the longitudinal center line of the conveyance, said board being adapted to be disposed in a substantially horizontal position with the front wheels unturned but so connected to the interconnecting means of the front wheels that depression of the board by body weight of the rider at a respective side of the board causes turning of the wheels in unison in the respective direction upon movement of the board.

7 Claims, 4 Drawing Sheets

FIG. 3
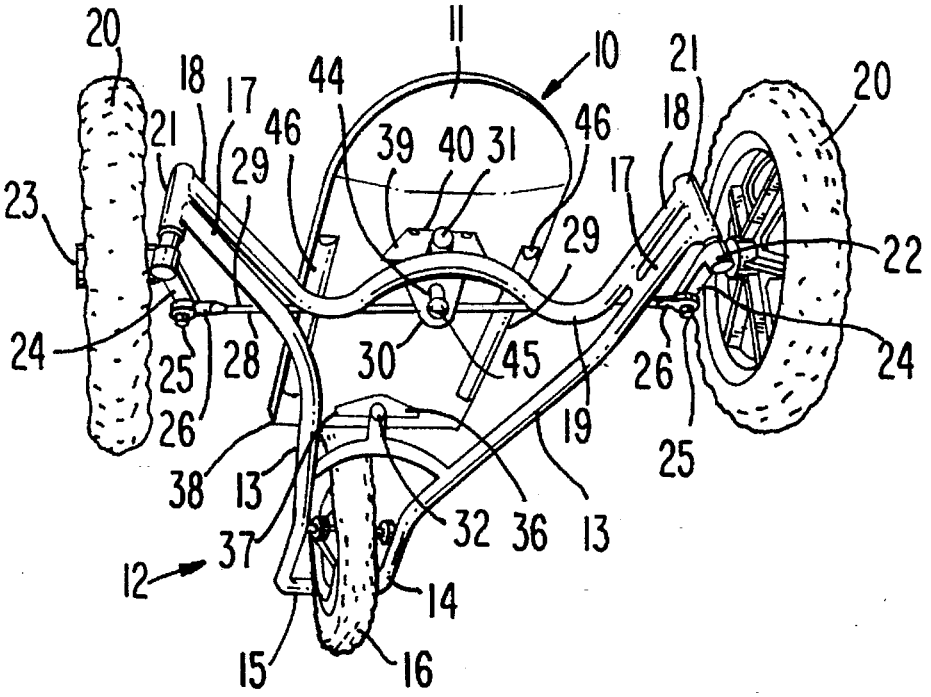
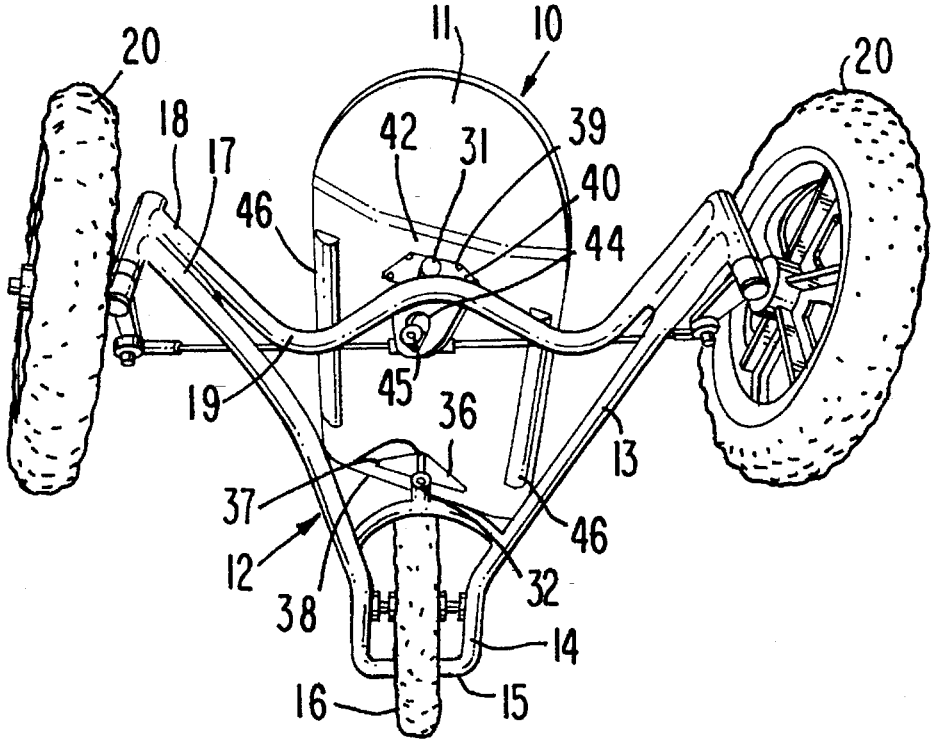
FIG. 4

FIG. 5
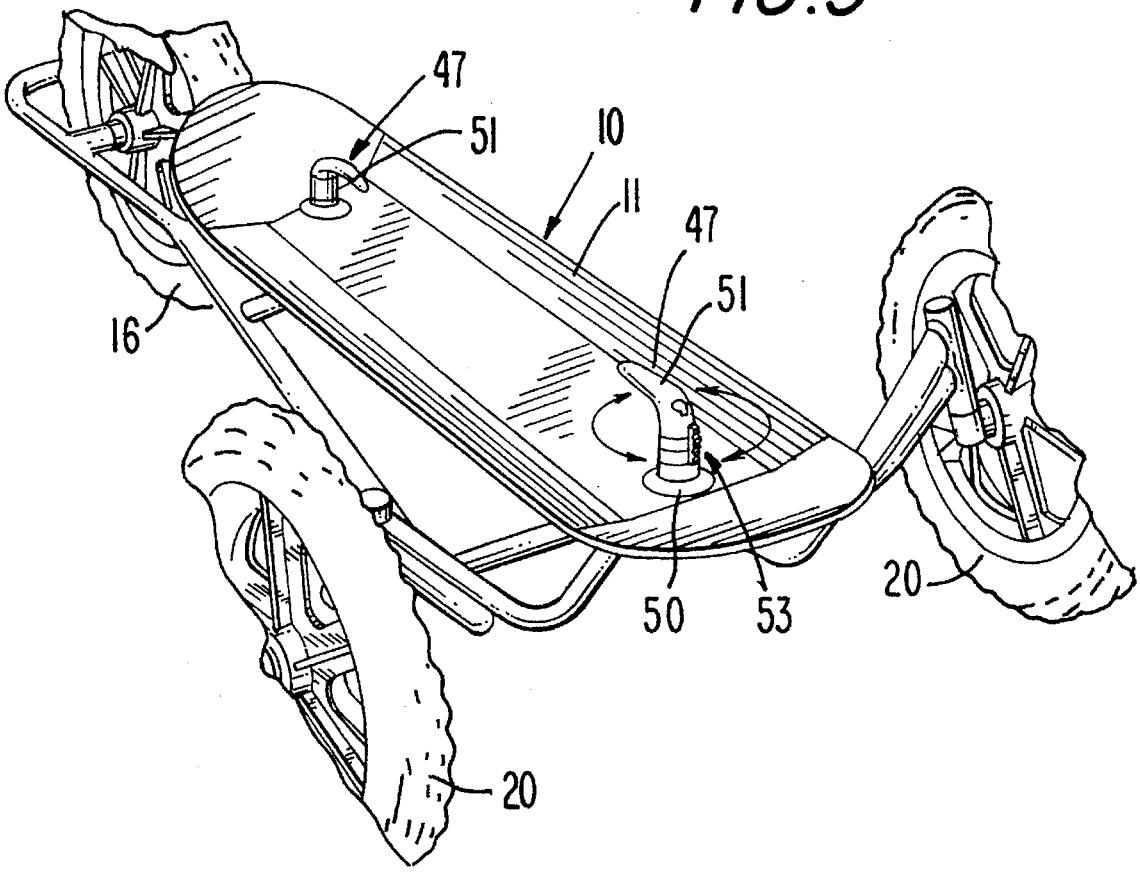
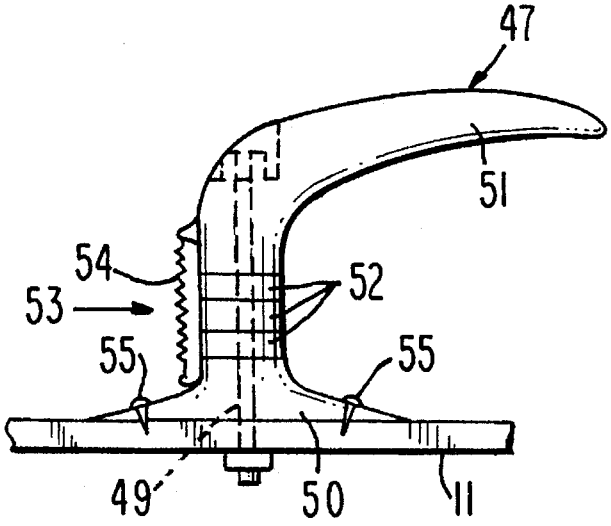
FIG. 6
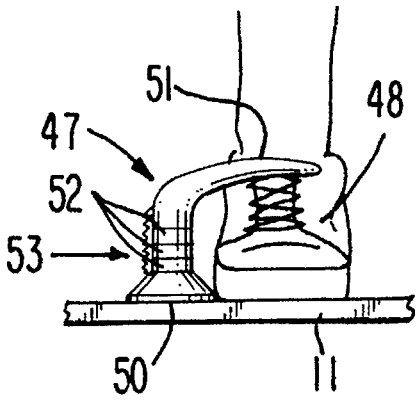
FIG. 7

SPORTS CONVEYANCE

TECHNICAL FIELD

This invention relates to a sports conveyance, and it is more particularly concerned with a sports conveyance of the type having land wheels, with or without motor propulsion, and adapted to carry a rider after the manner of a skateboard.

BACKGROUND ART

Sports-minded people derive great satisfaction and enjoyment; as well as pleasure in demonstrating their athleticism, from skateboards which enable them to transverse land at not-inconsiderable speed, standing on a wheeled platform which must be constrained in its directional requirements without the presence of steering wheels, handlebars or other manual control means. Conventional skateboards have not changed appreciably since they came into vogue about four decades ago. They were developed simply by placing a board—commonly called a "deck"—on roller skates at front and rear, and the turning mechanism has essentially remained the same, with the wheels being allowed, when the board is leaned by body weight, to turn in the direction of the lean. In certain further developments, larger skateboards have been produced—and with sails in some instances—aimed at obtaining better turning abilities, but without any noteworthy success. The fact remains that difficulty or limitation in turning invariably arises when small wheels are used and are located essentially under the board, with the wheels being unable to be spaced apart more than say 25 cm.

Another disadvantage associated with current types of skateboards is that their small, substantially solid wheels cause them to be limited to firm-surface terrain such as roads and footpaths, so that they cannot be used on sand or on grassed surfaces which may include sot areas. In consequence they cannot compete with grass skis where the latter are usable, and if fitted with sails or the like they are fraught with danger even exceeding the normal high incidence of accidents and damage to the person occurring when normal skateboard are used on concrete or the like surfaces, especially when their inherently low-stability characteristics are combined with the low-ability problems of inexperienced or accident-prone riders.

DISCLOSURE OF INVENTION

My invention has been devised with a view to overcoming the aforementioned disadvantages associated with current skateboards and it has for its principal object the provision of a sports conveyance which can be controlled to simulate all desirable features of a skateboard and yet will have major novel features of its own, such as the ability to be made with larger and more widely spaced front wheels at locations beyond the lateral limits of the board or deck. Another object of the invention, tied in with the ability to employ larger wheels, is the provision of a conveyance able to traverse grass and moderately firm sand. In particular the invention aims to provide a conveyance of the aforedescribed type having a novel turning mechanism permitting greater turning ability and greater turning control.

Further objects of the invention are to provide a new type of sports conveyance as aforementioned in which excellent use may be made of the leaning of body weight of the rider, as basically employed in a skateboard, and yet achieving great stability and safety, while being able to be made to simple and efficient design and at very reasonable cost, yet proving strong and durable in use.

It is a further object that, when so desired, a rider may be restrained against accidental separation from the conveyance as may occur on bumpy terrain. Yet another object is to provide such stability features that the rider's weight may be distributed most efficiently in operating conditions. Other objects will be apparent from consideration of specific modifications which can be provided and which are described herein.

With the foregoing and other objects in view, the invention resides broadly, according to one aspect, in a sports conveyance having a frame mounted on a pair of spaced front wheels and also supported by rear wheel means, the front wheels having interconnecting means whereby they may be turned in unison to either side of the line of intended motion, a board mounted on the frame to support a rider and having or comprising tiltable platform means adapted to be depressed at a respective side of the longitudinal centre line of the conveyance, said tiltable platform means being adapted to be disposed in inoperative attitude with the front wheels unturned but so connected to the said interconnecting means of the front wheels that depression of said platform means by body weight of the rider at a respective side of the board causes pivoting of the wheels in unison in the respective direction upon movement of the platform means.

In one practical embodiment of the invention, the rear wheel means is in the form of a single, medially disposed, freely rotatable wheel on a fixed axis towards the rear extremity of the board or platform, or behind the board, or there could be a pair of rear wheels. A rear extension of the frame behind a single rear wheel could be arranged to form a mounting for a leverage plate, preferably inclined upwards at its rear extremity for ground clearance purposes and adapted to receive a backwardly-placed foot of the rider. The latter could in that case exert reduced body weight on the other or front foot on the board and exert leverage force by body weight on the leverage plate to cause the front of the conveyance to be raised and so lift the front wheels, a simultaneous pivoting action about the single rear wheel being achievable with ease. However, other advantageous embodiments can be provided without the use of the extended leverage plate, or having a pair of rear wheels.

If desired, the board could be fixed on the frame and have movable depression flaps at each side extremity connected respectively to the means for turning the wheels, with springs or rubber bias means normally holding up the depression flaps, whereby body weight transference urges the rider to depress a respective flap against the bias with a part of a foot which overlaps the rigid part of the board. However, it is highly preferred that he board itself be hinged about a medial longitudinal axis, held up at each side, if found necessary or desirable, by rubber buffer or equivalent bias means, but tiltable to either side by body weight transference so that the tilting movement is converted to wheel-turning movement in the respective direction. Various board and selective depression systems may be used, such as a shorter rear board portion which is rigid on the frame and has front control depression flaps at its front at either side, hinged about lateral axes. While all such designs are possible, it is believed that the most popular and efficient system will have the total board in one-piece construction and symmetrical about the medial longitudinal line on or adjacent the longitudinal pivot axis therefor. In that event, a control rod or other member disposed on the pivot axis and secured to the platform will rotate about the axis so that a lever arm therefrom may turn in either direction and so pull a respective linkage arm of a parallel-motion steering arrangement for the front wheels.

Suitably the frame is designed to be low to the ground and supporting the deck thereabove at a level not appreciably above a horizontal plane through the transverse axis of the front wheels. In one embodiment the front end of the deck or platform is extended beyond the front transverse wheel axis so that the rider's foot can be supported thereon as a "front" foot when he is facing across the deck in operation, his other or "rear" foot being at the back of the deck which in this instance terminates short of the rear wheel location.

One preferred embodiment may employ a foot-grip member for each foot of the rider at the positions aforementioned so that a stirrup-type action is achieved to hold each foot on the board, but with quick-release means to allow each foot to be moved clear of the deck when so desired. For this purpose, each foot-grip member may be pivotally mounted and biased to its securing disposition, movement of the foot or pressure thereon causing the foot-grip member to move pivotally so that it is free of the rider's foot. Other features of the invention will be hereinafter apparent.

BRIEF DESCRIPTION OF DRAWINGS

In order that the invention may be even more readily understood and put into practical effect, reference will now be made to the accompanying drawings, wherein:

FIG. 3 is a front underneath perspective view of the conveyance in the attitude shown in FIG. 1;

FIG. 4 is a front underneath perspective view, corresponding to FIG. 3, but showing the conveyance platform tilted, and with the front wheels resultantly turned, but in the opposite direction to that of FIG. 2;

FIG. 5 is a fragmentary perspective view, corresponding to FIG. 1, but having its platform, board or deck fitted with front and rear foot-grip members;

FIG. 6 shows in greater detail, in side elevation, one of the foot-grip members illustrated in FIG. 5;

FIG. 7 is similar to FIG. 6 but shows the gripping action of one of the foot-grip members on a rider's foot;

BEST MODE FOR CARRYING OUT THE INVENTION

Figure 1:
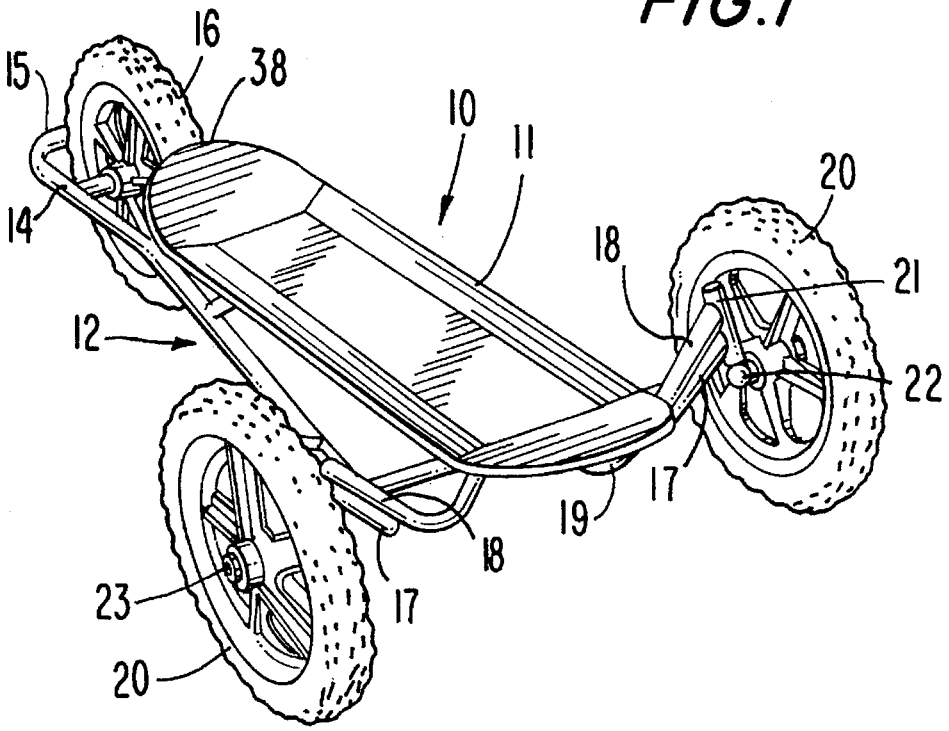
FIG. 1 shows in front perspective view, from above, one illustrative example of a sports conveyance in accordance with the invention, the front wheels being in unturned, inoperative or straight-ahead attitudes.
Figure 2:
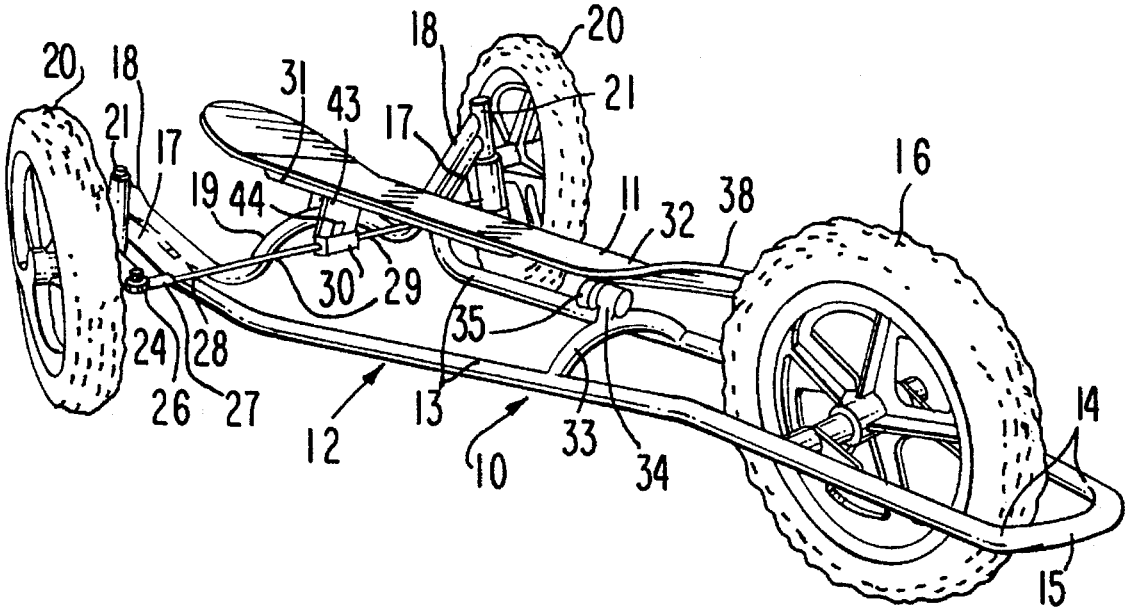
FIG. 2 is a rear perspective view, from above, of the conveyance of FIG. 1, but the conveyance platform, deck or board being shown tilted to one side and the front wheels resultantly turned.

Considering firstly the embodiment of FIGS. 1 to 4, the conveyance indicated generally by the numeral 10 is shown as having a single or one-piece board 11 mounted on a frame 12 so that it is tiltable to either side of the medial longitudinal line. The frame 12 has a continuous tubular member which is U-shaped in plan view so that it defines spaced front portions 13 integral with spaced rear portions 14 which are connected by a terminal connector portion 15. The rear portions 14 have mountings for a fixed transverse axle about which a single medial rear wheel 16 is freely rotatable.

The spaced front tubular portions 13 of the frame 12 are splayed forwardly and downwardly to terminate in upwardly and outwardly curved support members 17 welded beneath respective ends 18 of a cross-tube 19. The two front wheels 20 are each mounted beneath a sleeve 21 welded to respective members 17 and 18 at the respective ends of the cross-tube 19, each sleeve 21 thus being inclined from top to bottom in a forwardly and outward manner to accommodate a king pin rotatable in a nylon insert (not shown) while the lower end 22 of the king pin has a stub axle 23 at an angle allowing it to be horizontal and transverse when the wheel is unturned. Also secured to the lower end 22 of the king pin is a right-angle, substantially horizontal lever arm 24 having near its free end a pivot aperture to receive a pivot bolt 25 of a respective coupling member 26. The latter has its pivot bolt 25 near to its outer end, while the inner end 27 is tapped to receive adjustably the threaded end 28 of a respective linkage arm 29 of a pair of such arms connected end-to-end at the middle of the conveyance by a block 30.

In order to turn the front wheels 20 upon tilting the board 11, the latter has horizontal longitudinal pivot axes in line at front and rear at 31 and 32 respectively. For the rear pivot mounting, an upwardly bowed mounting tube 33 extends transversely between the frame members 13 and has a medial sleeve 34 rigid thereon to receive a pivot pin on said axis 32 of a mounting member 35 welded beneath a plate 36 secured by screws 37 beneath the rear of the board 11 forwardly of the latter's rear extremity 38 just in front of the rear wheel 16. The co-linear pivot axis 31 near the front of the board is provided by similar arrangements, there being a plate 39 secured by screws 40 and having a pin-mounting member 41 pivotable about the axis 31 on medial sleeve 42 welded at the middle of the upwardly bowed portion of the cross-tube 19. The pin-mounting member 41 has a rigid operating arm 43 extending down and provided with a lost-motion aperture 44 through which fits loosely a nylon bush member 45 secured to the aforementioned block 30 connecting the two co-linear transverse linkage arms 29. All components are suitably journalled where necessary so that pivoting of the board or platform 11 about the longitudinal line of the front and rear axes 31 and 32 will cause the front wheels 20 to be turned to one side or the other.

In this case, the board 11 has beneath each side a longitudinal strengthening bar 46 but any of a number of simple engineering techniques could be employed in order to attain adequate strength and efficiency without undue cost. The dimensions of the wheels, as well as other component lengths, widths and heights can be varied as desired to suit different conditions and requirements, but by way of example each wheel can be about 30 cms in diameter with inflated tires of about 5 cms width. Thus, the board will be suitably low to the ground and great stability will be achieved, even fairly soft sand being traversable with these embodiments. In the example of FIGS. 1 to 4, there is a distance between front and rear wheel axes of about 70 cms, with a spacing of about 50 cms between the inside faces of the front wheels. The rear wheel could be designed to be motorised by any suitable small engine usable when desired, such as for uphill travel. The design also lends itself readily to the inclusion of brakes, such as mechanisms similar to those used on scooters. Some riders may prefer to provide bias means to return the board to horizontal disposition and the wheels to straight-ahead attitudes when turning is not employed. The bias means could take the form of compression or tension springs suitably arranged, or simple rubber or elasticised straps could be extended from the side edges of the board to be secured under the frame members. It may be found desirable to provide a cowling over the front of the frame to protect the movable parts of the steering mechanism and also to keep the rider clear of anything which might be damaging to the person if accidentally encountered. The board can be modified to assist a kneeling attitude of the rider, or it could be fitted with chair-support means within which a physically handicapped person could be seated and thus obtain the benefits of the conveyance.

The modified conveyance 10 of FIG. 5 is the same as that of FIGS. 1 to 4, but the front portion of the board 11 just in front of the cross-tube 19 has a foot-grip member 47, while an identical foot-grip member 47 is provided near to the rear end of the board 11 in front of the rear wheel 16. In this case the rider whose feet and ankles are shown in FIG. 7 can hook his feet under the foot-grip members 47 to avoid separating from the board, or he can be more enterprising or acrobatic to an extent where the foot-grip members are used only in specific applications such as on very bumpy terrain or for lifting the board as he jumps. Thus the foot-grip members 47 can be preferred options for the conveyance and used according to the age and experience of the rider as well as the operating conditions. Most riders will find the foot-grip members 47 beneficial in any event for better balance when placed to use the end extremities of the board, the front extremity of the board being well forward for this purpose.

The grip members 47 can be of desired form in order to provide a stirrup-type action, one type being as shown in FIG. 6 in side elevation, while FIG. 7 is a similar view showing gripping of a rider's foot 48. In this case, the deck or board 11 has an attachment bolt 49 secured through an aperture and passing through a shaped base member 50 so that a stirrup arm 51 may extend horizontally out from the bolt 49 and pivot about the vertical axis provided by the latter. A desired number of spacer blocks 52 may surround the bolt 49 between the base 50 and the stirrup arm 51 and the latter may be biased to point down the length of the board by the provision of bias means 53 in the form of a spring 54 or elastic material to allow a pivot of up to 180 degrees in either direction and then return to original disposition. Thus a foot may-be held by the instep or other outside part to face across the deck, but the quick-release features allow the feet to separate from the deck when desired or when beneficial for safety purposes. The base 50 may be secured by a desired number of screws 55, and the spacer blocks 52 can be in desired number to suit particular sizes of feet.

Figure 8:
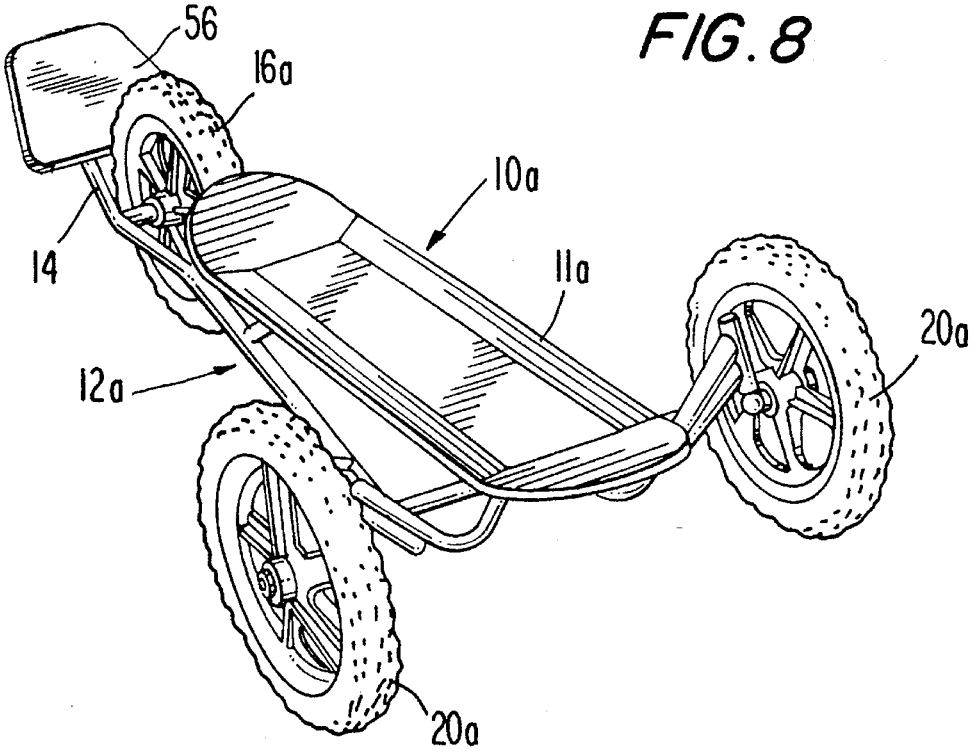
FIG. 8 is a similar perspective view to FIG. 1 but showing a modified conveyance having a rear leverage plate.

The modified conveyance 10 of FIG. 8 is basically the same as that of FIGS. 1 to 4 except that the frame **12*a* is extended at its rear extremity and provided with a leverage plate 56 which extends upwards and backwards so that a rider can place a "rear" foot on the plate 56** and organize his balance so that he can pivot the conveyance spectacularly or otherwise about the rear wheel for achieving efficient and thrilling or otherwise satisfying front wheel lifting and sharp turning. The other features are the same as before but suffixed in the drawing by the letter "a".

Figure 9:
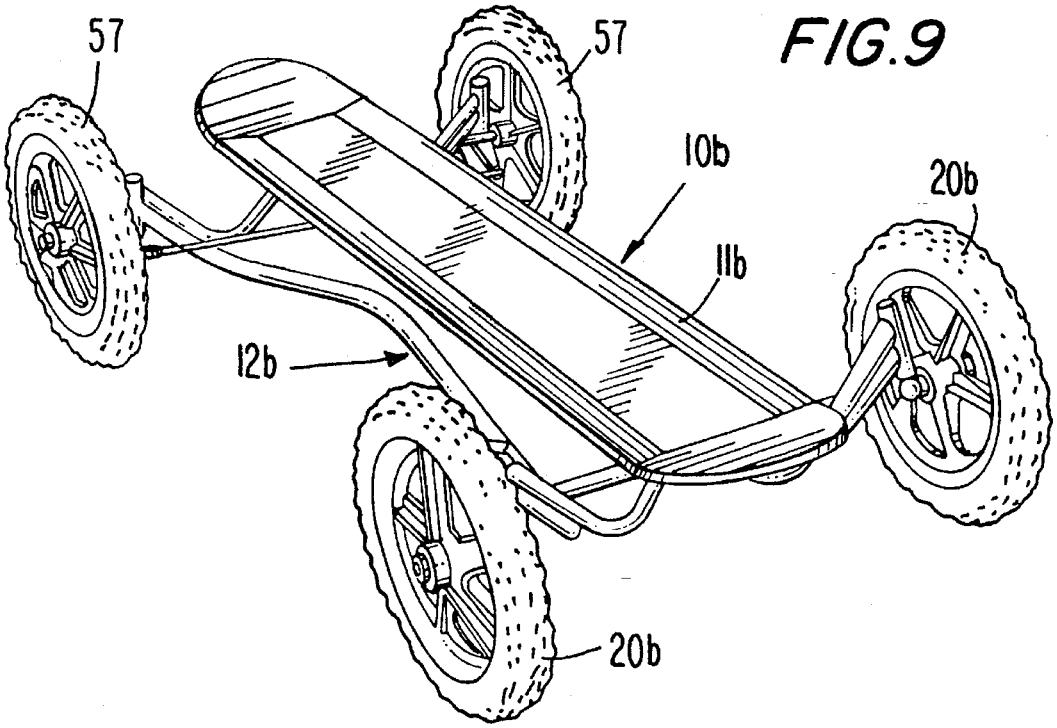
FIG. 9 shows another modified conveyance having two rear wheels instead of a single one.

It will be apparent from the further modified conveyance **10*b* of FIG. 9 that the single rear wheel could be replaced by a pair of rear wheels 57 rotatable freely about a fixed transverse axis or linked to the board 11*b*** to be steered thereby in any desired manner, including currently introduced "four wheel steering" as for motor cars. The other components are the same as before but suffixed in the drawing by the letter "b".

The operation of the various conveyances will be clear from the preceding descriptions and it will be apparent that the described embodiments will be found very effective in achieving the objects for which the invention has been devised. However, many modifications have been mentioned and serve to illustrate how the embodiments are illustrative only and may be subject to many more variations in detail and design, as will be readily apparent to persons skilled in the art, and all of which are deemed to reside within the scope and ambit of my invention, as defined by the appended claims.

I claim:

1. A sports conveyance comprising:

a substantially flat, elongate, rider-supporting board having spaced longitudinal side edges extending between front and rear ends of the board;

frame means connected to the board in such manner that the board is tiltable about a longitudinal tilt axis, the board being symmetrical to either side of the tilt axis so that the longitudinal side edges of the board are at equal distances on opposite sides of the tilt axis;

said frame means including a rear frame section supported by rear wheel means permitting motion of the board in the direction along said tilt axis;

said frame means including a forward frame section supported by a pair of steerable front wheels disposed at equal distances on opposite sides of the board and spaced from the longitudinal side edges of the board;

said front wheels having respective stub axles in respective wheel mountings arranged to permit rotation of the front wheels about axes transverse to said longitudinal tilt axis;

interconnecting means between the front wheels whereby they may be turned in unison to either side of the direction along said tilt axis;

the board being adapted to be disposed in either an untilted substantially horizontal disposition in which the front wheels permit motion of the conveyance in the direction along the tilt axis or in a selected tilted disposition, the board being so connected to the said interconnecting means of the front wheels that depression of the board by body weight of the rider at a respective side of the board causes turning of the front wheels in unison for steering in the corresponding direction;

said front wheels having their wheel mountings connected by said forward frame section which extends transversely beneath the board rearwardly of the front end of the board, said forward frame section having said tilt axis midway along its length, while to each side of said tilt axis the forward frame section is of a shape defining a depression or bowed portion at a lower height than the tilt axis to accommodate a respective side edge of the board when the latter is tilted to the maximum extent at the respective side of the tilt axis.

2. A sports conveyance according to claim 1, wherein said forward frame section is a single rod-like frame member having its opposite ends connected to the respective wheel mountings at substantially the same height as the said tilt axis, the rod-like frame member being downwardly bowed to define said depression at each side of the tilt axis by virtue of the tilt axis being disposed on an elevated board-mounting portion of the forward frame member midway along its length.

3. A sports conveyance according to claim 2, wherein said rod-like frame member is of substantially W-shaped formation when viewed in the direction along the tilt axis, and is of linear formation at right angles to the tilt axis when viewed from above in plan view.

4. A sports conveyance according to claim 3, wherein the frame means includes rod-like side frame members extending longitudinally below the level of the tilt axis and connecting said rear frame section to said forward frame section.

5. A sports conveyance according to claim 4, wherein said side frame members towards the rear ends of said side frame members, but forwardly of the rear wheel means, are interconnected by a rear transverse mounting member of rod-like form, said rear transverse mounting member having an elevated portion midway along its length and constituting a rear support on which the board is mounted for movement about said tilt axis.

6. A sports conveyance according to claim 5, wherein the elevated middle portion of the rear transverse mounting member and the elevated portion of the front transverse frame member are each provided with a fixed journal sleeve to receive respective pivot pins secured longitudinally beneath the board and defining said longitudinal tilt axis.

7. A sports conveyance according to claim 1, wherein the board has attached thereto at least one foot-grip member for holding the rider's foot or feet in desired temporarily retained attitude, said at least one foot-grip member being pivotally mounted for quick-release action but biased towards a foot-securing disposition.

* * * * *